US008469840B2

(12) United States Patent
Mourouzis et al.

(10) Patent No.: US 8,469,840 B2
(45) Date of Patent: Jun. 25, 2013

(54) KICKOFF TEE AND PLACEMENT TEE

(76) Inventors: Nick Mourouzis, Greencastle, IN (US); David M. Finzer, Glenview, IL (US)

( * ) Notice: Subject to any disclaimer, the term of this patent is extended or adjusted under 35 U.S.C. 154(b) by 74 days.

(21) Appl. No.: 13/160,652

(22) Filed: Jun. 15, 2011

(65) Prior Publication Data

US 2012/0322586 A1 Dec. 20, 2012

(51) Int. Cl.
*A63B 71/00* (2006.01)
*A63B 69/00* (2006.01)

(52) U.S. Cl.
USPC ..... 473/419; 473/420

(58) Field of Classification Search
USPC ..... 473/419, 420, 257, 417, 422, 268; D21/715–718
See application file for complete search history.

(56) References Cited

U.S. PATENT DOCUMENTS

| | | | | | |
|---|---|---|---|---|---|
| 3,309,087 | A * | 3/1967 | Cullity | 473/420 |
| 3,481,602 | A * | 12/1969 | Tatter | 473/420 |
| 5,240,254 | A * | 8/1993 | Adlam | 473/257 |
| 5,437,448 | A * | 8/1995 | Balson | 473/257 |
| 6,514,151 | B2 * | 2/2003 | Delaplane | 473/268 |
| D579,994 | S * | 11/2008 | Lowinger | D21/716 |

* cited by examiner

*Primary Examiner* — Mitra Aryanpour

(57) ABSTRACT

A kickoff tee and a placement tee are disclosed. The kickoff tee has a kicking surface surrounded by a horseshoe-shaped support wall defining an open-ended kicking channel. The support wall can further include a pair of opposing protrusions that taper from the top of the support wall downwards toward the kicking surface. The placement tee exhibits a kicking surface atop a kicking platform. The kicking surface includes a kicking target than can be surrounded by a plurality of concentric support ridges. Additionally, the placement tee has a lateral surface extending from the kicking surface downward towards the ground. The lateral surface can exhibit one or more visual indicators to facilitate lining up of a place kick.

6 Claims, 7 Drawing Sheets

KICKOFF TEE AND PLACEMENT TEE

BACKGROUND

This invention relates to football kicking tees of the type used for support of a standard, ellipsoidal football during kickoffs, on-side kicks, field goals, and extra points, as well as the practice of the same. In the sport of football, the football is typically supported by a kickoff tee during kickoffs and on-side kicks. Additionally, at the high school level or below, the football is placed atop a placement tee during field goals and extra points.

Several kicking techniques have been developed with respect to both kicking off and placekicking, and various kicking tees have been designed to accommodate the different techniques. For example, some kickoff and placement tees are designed for a kicker using a so called "straight-away" kicking style, where the kicker approaches the football from directly behind the football and the kicking tee. The kicker then makes contact with the football with the toe portion of his foot and kicks the football using a kicking motion in which his leg more or less follows the intended trajectory of the football. Other tees in the prior art have been designed specifically for kickers using a so called "soccer" kicking style. Kickers who have adopted the soccer kicking style typically approach the ball from an angle behind the football and the kicking tee. The kicker then makes contact with the ball with the instep of his foot, a portion on the inside of the foot between the toe and the ankle. Both the straight-away and soccer kicking styles are suitable for kickoffs, on-side kicks, and placement kicks.

Regardless of a kicker's kicking style, a kicking tee must be suitable for both supporting a football prior to the kick and releasing a football kicked therefrom. Many tees in the prior art that concentrate on providing additional support to a football prior to the kickoff sacrifice a free release of the football from the tee. Conversely, many tees that emphasize a free release of the football provide poor support for the football prior to the kick. Additionally, kicking tees that have been designed with straight-away kickers in mind are not suitable for soccer style kickers and, conversely, kicking tees designed for soccer style kickers are not ideal for straight-away kickers.

Thus, there is a need for improved kicking tees, including both kickoff tees and placement tees, that are suitable for use in conjunction with a variety of kicking techniques, provide adequate support for a football prior to a kick, and provide a free release of the football from the tee following the kick.

SUMMARY OF THE DISCLOSURE

In accordance with certain embodiments of the present disclosure, kickoff tees and placement tees are disclosed. The kickoff tees can be suitable for both kickoffs and on-side kicks. Additionally, the kickoff tees can be used with multiple kicking techniques, including straight-away and soccer kicking styles.

In one aspect, a kicker can approach a football supported by the kickoff tees from a wide range of angles, granting the kicker freedom in his approach to the tee and allowing him to disguise where and how he intends to kick the ball.

In another aspect, the kickoff tees can simultaneously provide adequate support to hold a football upright prior to a kick and permit a free release of the football following the kick.

In a further aspect, the kickoff tees can adequately support a football at a variety of angles. For example, a kicker can use the kickoff tee to lean a football left, right, front, or back with respect to the kickoff tee.

The placement tees described herein are suitable for use in conjunction with both field goals and extra points. In one aspect, the placement tee is shaped in such a way as to enhance the kicker's ability to line up for a kick. For example, in one exemplary embodiment, the placement tee can comprise visual indicators that facilitate the lining up of a kick.

In another aspect, the placement tee can provide a visual target that draws a kicker's eye to the tee and the football. In this manner, it is easier for a kicker's focus to go back and forth between the football and the goal posts. Additionally, the visual target can draw a placeholder's (or holder's) eye to the placement tee more quickly. This facilitates quicker placement of the football by the placeholder after the snap and minimizes the risk of the placeholder placing the football on the placement tee improperly. The visual target can also provide a reference point shared by the kicker and the placeholder to eliminate any confusion as to where the football will be placed.

Additional objects and advantages of the present disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the invention.

DESCRIPTION OF EXEMPLARY EMBODIMENTS

Disclosed herein are various kickoff and placement tees used in conjunction with kickoffs, on-side kicks, field goals, and extra points. Generally, the kickoff tee can accommodate numerous kicking styles, including straight-away and soccer kicking styles. In one aspect, the kickoff tee permits a kicker to approach a football supported thereon from a wide variety of approach angles without adversely affecting the football's release from the tee. In another aspect, the kickoff tee can provide adequate support to hold the football in place prior to the kick and allow the football a free release from the tee following the kick. The football can also be supported by the tee at a variety of angles if the kicker desires to angle the ball on the tee.

The placement tee can also accommodate numerous kicking styles. In one aspect, the placement tee can provide visual indicators to a kicker to facilitate the kicker's lining up of the kick and enhance the kicker's ability to focus on the tee and the football. In another aspect, the placement tee can provide visual indicators to a placeholder supporting a football on the placement tee. These visual indicators assist the place holder in placing the football upon the placement tee as fast as possible and in the location that the kicker expects. Further, in at least one embodiment, the visual indicators provide a mechanical grip to the football when the ball is placed atop the tee.

Reference will now be made in detail to certain exemplary embodiments of both the kickoff tee and the placement tee, examples of which are illustrated in the accompanying drawings. Wherever possible, the same reference numbers will be used throughout the drawings to refer to the same or like items.

Figure 1:
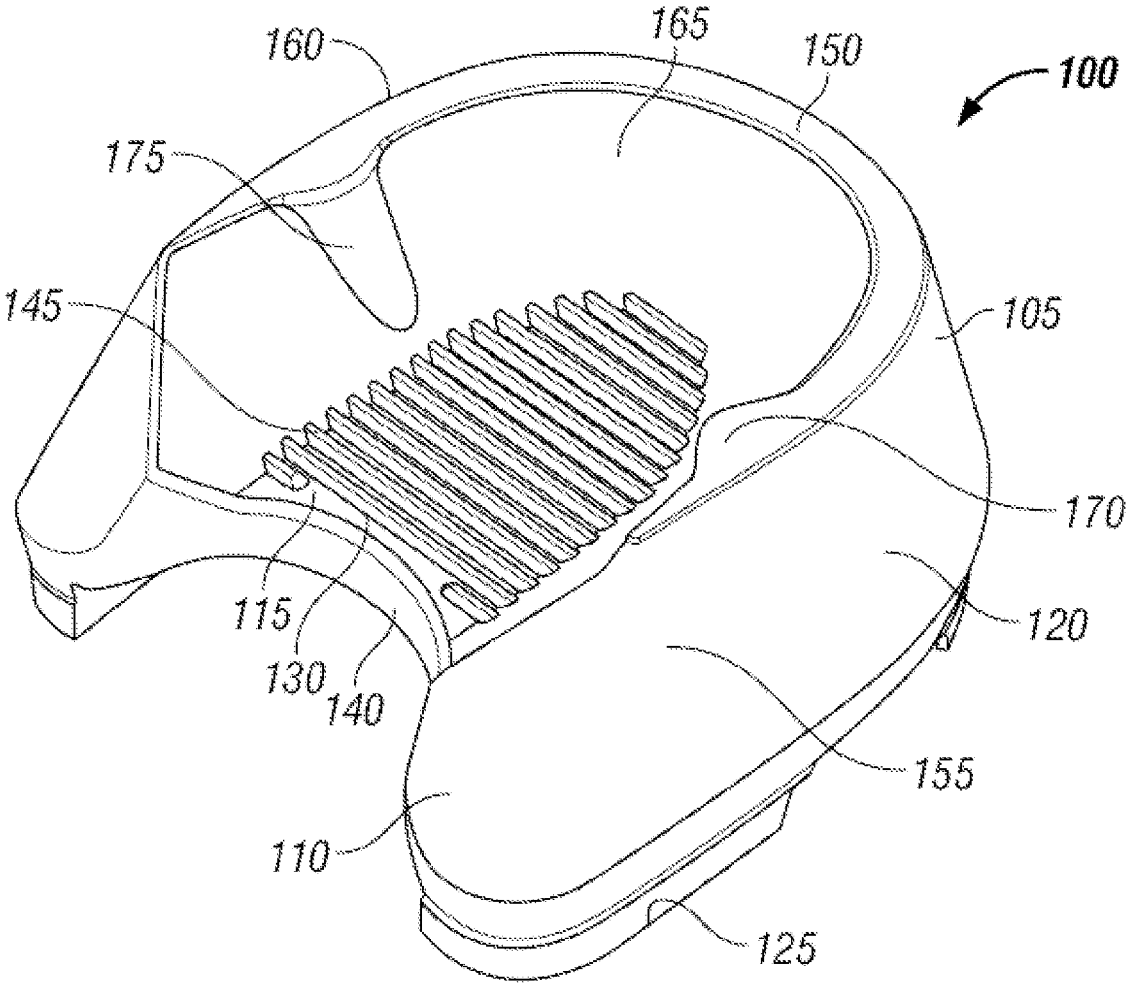
FIG. 1 is a perspective view of an exemplary embodiment of a kickoff tee as described herein.

FIG. 1 depicts an exemplary embodiment of a kickoff tee 100. In one aspect, the kickoff tee comprises a closed proximal end 105 and an open distal end 110. In another aspect, the kickoff tee can comprise a base portion 115, a support wall 120, and leg portions 125. In one embodiment, base portion 115, support wall 120, and/or leg portions 125 can be integrally formed using a single mold. In other embodiments, base portion 115, support wall 120, and leg portions 125 can be distinct pieces coupled to one another in some fashion.

Kickoff tee 100 can be made of any suitable material. In one embodiment, the kickoff tee can comprise a plastic or elastomer. In some embodiments, the rubber or elastomer can be relatively soft so as to prevent injury to a kicker who inadvertently strikes the tee while attempting a kick. In other embodiments, the kickoff tee can be comprised of a harder rubber or elastomer. Alternatively, the kickoff tee, or any of its constituent parts, can comprise some other material, such as rubber, polymer, metal, or wood. It is noted that this list of materials is not intended to be exhaustive and is only exemplary in nature. In further embodiments, multiple materials can be used to construct one or more portions of the kickoff tee.

In another aspect, the kickoff tee is sized in accordance with the applicable rules governing the game of football in which it is used. In one embodiment, the kickoff tee is approximately 4.5 inches wide, 2 inches tall, and 5 inches long. In other embodiments, the kickoff tee exhibits a shorter or longer width, a shorter or longer height, and/or a shorter or longer length.

In one aspect, base portion 115 of kickoff tee 100 can be comprised of an upper kicking surface 130, a lower surface 135 (depicted in FIG. 3), and an on-side kick support surface 140. In one embodiment, kicking surface 130 can be a substantially horizontal surface with a perimeter resembling the perimeter of a partial prolate spheroid or ellipsoid at both its proximal and distal ends. It is noted that the terms "prolate spheroid" and "ellipsoid" are not used here in their precise geometric sense. Rather, a section of these shapes can resemble the surface area of kicking surface 130. In other embodiments, the surface area of kicking surface 130 can exhibit some other shape. For example, the perimeter of kicking surface 130 can resemble the perimeter of a circle at the proximal and/or distal end. Alternatively, kicking surface 130 can resemble a polygon comprised of a plurality of linear sides. In further embodiments, the perimeter of kicking surface 130 can comprise some combination of linear and curvilinear sides. Further, rather than being substantially horizontal, kicking surface 130 can lie in a plane at some angle to the ground. For example, kicking surface 130 can lie in a plane angled such that distal end 110 of kicking surface 130 is closer to the ground than proximal end 105 of kicking surface 130. Alternatively, kicking surface 130 can lie in a plane angled such that distal end 110 of kicking surface 130 is farther from the ground than proximal end 105 of kicking surface 130.

In one aspect, kicking surface 130 is relatively wide with respect to the overall width of kickoff tee 100. In one embodiment, kicking surface 130 can be approximately 1.5 inches wide at its widest portion, while kickoff tee 100 can be approximately 4.5 inches wide at its widest portion. In other embodiments, the kicking surface, at its widest portion, is 25% of the width of kickoff tee 100 at its widest portion. In further embodiments, the kicking surface, at its widest portion is greater than 33% of the width of kickoff tee 100. In still further embodiments, the kicking surface, at its widest portion is greater than 33% of the width of kickoff tee 100.

In one embodiment, kicking surface 130 can be approximately 1 inch high with respect to the ground. In other embodiments, kicking surface 130 can be higher or closer than 1 inch from the ground and/or any height dictated by the rules governing the particular football game. For example, kicking surface 130 can be approximately 2 inches high with respect to the ground.

In another aspect, kicking surface 130 can comprise a plurality of support ridges 145. Support ridges 145 can be formed integrally with kicking surface 130 or separately from kicking surface 130 and then coupled thereto in some fashion. Further, support ridges 145 can be comprised of the same material as base portion 115 or support ridges 145 can be comprised of any other suitable material. In one embodiment, each of support ridges 145 runs laterally across the kicking tee. In other embodiments, support ridges 145 can be oriented in a different direction.

In one aspect, support ridges 145 can extend 1/16 of an inch from kicking surface 145. In other embodiments, support ridges 145 can be shorter than 1/16 of an inch. In further embodiments, support ridges 145 can be taller than 1/16 of an inch.

In another aspect, support ridges 145 can serve to provide additional support to the lower tip of a football placed in the tee. The support ridges provide friction to the lower tip of a football and thereby help stabilize the football when it is placed in kickoff tee 100. This feature can prevent the football from moving or falling off kickoff tee 100 prior to the kick. In other embodiments, rather than support ridges 145, kicking surface 130 can exhibit a plurality of dimples or a plurality of pyramid-like gripping elements. It is noted, with respect to at least one embodiment, that regardless of what structure (e.g., support ridges 170) may be present on kicking surface 130, that structure does not rise above the lower tip of a football placed in kickoff tee 100. In other words, the lower tip of the football can rest atop support ridges 170 (or dimples, gripping elements, etc.), but support ridges 170 do not rise above the lowest point on the football. In this manner, a free release of the lower end of the football from kicking surface 130 and kickoff tee 100 is ensured.

In additional embodiments, rather than exhibiting support ridges 170 or the like, kicking surface 130 can be relatively rough with a high coefficient of friction. In still further embodiments, kicking surface 130 can be relatively smooth with a lower coefficient of friction.

In one aspect, on-side kick support surface 140 can be adjacent kicking surface 130 and located at the open face or distal end of base portion 115. In one embodiment, on-side kick support surface 140 can be a substantially vertical surface or oriented at approximately 90° with respect to the ground. In other embodiments, on-side kick support surface can be oriented at some angle with respect to the ground greater than or less than 90°. In another aspect, on-side kick support surface 140 can follow a curvilinear or linear path. In one embodiment, on-side kick support surface can follow a curvilinear path suitable for supporting a lateral side of a football that is placed on the ground in front of kickoff tee 100. In this manner, the lower tip of the football can rest on the ground in front of the tee and the football can be leaned back against on-side kick support surface 140.

In another aspect, on-side kick support surface 140 can be relatively rough, exhibiting a high coefficient of friction. In other embodiments, on-side kick support surface 140 can be relatively smooth, exhibiting a lower coefficient of friction.

In one aspect, support wall 120 can comprise a proximal portion 150 and opposing lateral portions 155, 160. In one embodiment, proximal portion 150 and opposing lateral portions 155, 160 can be formed integrally with one another. In other embodiments, proximal portion 150 and opposing lateral portions 155, 160 can be distinct elements coupled to one another in some fashion.

In another aspect, support wall 120 can enclose kicking surface 130 at its proximal end and on the lateral sides of kickoff tee 100. In one embodiment, support wall 120 follows the shape of kicking surface 130. In this manner, where kicking surface 130 is elliptical in shape, support wall 120 is "horseshoe-shaped" or "U-shaped," forming a kicking channel between opposing lateral portions 155, 160. Where kicking surface 130 exhibits some other shape, support wall 120 can be formed accordingly. The two opposing ends of support wall 120 terminate at the distal end of kickoff tee 100, leaving an open face through which a football can exit the kicking channel freely. Additionally, the kicking channel provides a kicker kicking an on-side kick with an open path for his foot to strike the football.

In one embodiment, each opposing end of support wall 120 can taper from the ground towards the top of support wall 120. In other embodiments, each opposing end of support wall 120 can be perpendicular to the ground. In further embodiments, each opposing end of support wall 120 can comprise any linear or curvilinear profile, including a combination of linear and curvilinear portions.

In another aspect, support wall 120 tapers in thickness from kicking surface 130 to the top of support wall 120. In some embodiments, inner surface 165 of support wall 120 tapers away from kicking surface 130. In one embodiment, inner surface 165 can comprise a curvilinear profile so as to form a partial "bowl-like" shape. In other embodiments, inner surface 165 can exhibit a linear profile so as to form a partial inverted "cone-like" shape.

In one embodiment, support wall 120 can be approximately 1 inch tall with respect to kicking surface 130. In other embodiments, support wall 120 can be taller or shorter than 1 inch with respect to the kicking surface and/or any height dictated by the rules governing the particular football game. Additionally, support wall 120 can be approximately 2 inches tall with respect to the ground, including the height of leg portions 125. Alternatively, support wall 120 can be taller or shorter than 2 inches with respect to the ground, including the height of leg portions 125, and/or any height dictated by the rules governing the particular football game.

In yet another aspect, inner surface 165 of support wall 120 can comprise opposing protrusions 170, 175. In one embodiment, opposing protrusions 170, 175 can be formed integrally with support wall 120. In other embodiments, opposing protrusions 170, 175 can be distinct pieces coupled to inner surface 165 of support wall 120 in some fashion. Further, opposing protrusions 170, 175 can be comprised of the same material as inner surface 165 of support wall 120 or exhibit the same texture as inner surface 165. Alternatively, opposing protrusions 170, 175 can be comprised of a different material than inner surface 165 or exhibit a different texture than inner surface 165.

In one embodiment, protrusions 170, 175 can exhibit a substantially semi-circular or semi-elliptical cross section, tapering from the top of support wall 120 towards kicking surface 130. In other embodiments, protrusions 170, 175 can exhibit some other cross section. For example, protrusions 170, 175 can exhibit a triangular, rectangular, or square cross section.

In one aspect, protrusions 170, 175 can taper downward and terminate prior to intersecting kicking surface 130. In other embodiments, opposing protrusions 170, 175 can intersect with kicking surface 130. In further embodiments, the top of protrusions 170, 175 can be located some distance away from the top of support wall 120.

In an embodiment where protrusions 170, 175 taper downwards toward the ground and inner surface 165 of support wall 120 tapers upward toward the top of kickoff tee 100, protrusions 170, 175 resemble a portion of an inverted cone.

In one embodiment, opposing protrusions 170, 175 can be located at substantially the midpoint of lateral portions 155, 160 of support wall 120. In other embodiments, opposing protrusions 170, 175 can be located toward the proximal end of kickoff tee 100. Alternatively, opposing protrusions 170, 175 can be located toward the distal end of kickoff tee 100.

In another aspect, kickoff tee 100 comprises leg portions 125. In one embodiment, leg portions 125 can be formed integrally with base portion 115 and/or support wall 120. In other embodiments, leg portions 125 can be distinct elements coupled to kickoff tee 100 in some fashion. Further, leg portions 125 can be made of the same material as base portion 115 and/or support wall 120. Alternatively, leg portions 125 can be made of some other suitable material.

In one embodiment, leg portions 125 can comprise four legs that extend from lower surface 135 of base portion 115 to the ground. In other embodiments, leg portions 125 can comprise more than four legs. In further embodiments, leg portions 125 can comprise fewer than four legs. In still further embodiments, leg portions 125 can comprise a single leg that extends around the proximal and lateral sides of kickoff tee 100. Alternatively, kickoff tee may not comprise leg portions 125 at all. In such an embodiment, lower surface 135 of base portion 115 can be placed in contact with the ground when kickoff tee 100 is in use.

Figure 2:
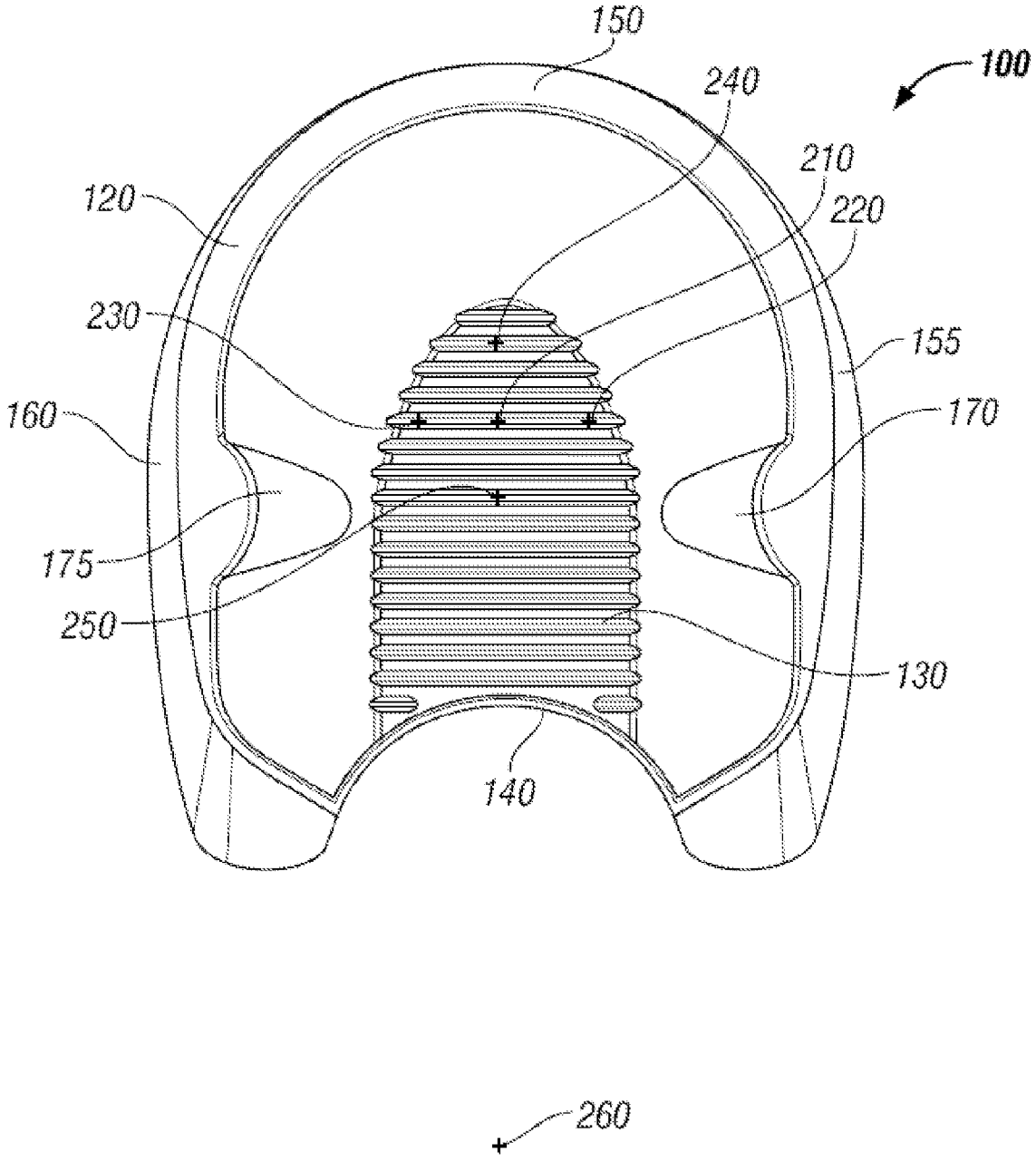
FIG. 2 is a top view of the exemplary embodiment of a kickoff tee as described herein.

FIG. 2 depicts a top view of kickoff tee 100. Due to the width and length of kicking surface 130, as well as the support provided by support wall 120 and opposing protrusions 170, 175, a kicker can orient a football on kickoff tee 100 in numerous ways. For example, a kicker can place the lower end of a football on kicking surface 130 near point 210, lying substantially along the longitudinal axis of kickoff tee 100, just proximal opposing protrusions 170, 175 if the kicker desires to orient the football substantially vertically. In this manner, the lower tip of the football can be supported by kicking surface 130, support wall 120 can support the face of the football facing the kicker, and opposing protrusions 170, 175 can provide support to the face of the football facing away from the kicker. On the other hand, the kicker can place the lower tip of the football on kicking surface 130 at a location offset from its longitudinal center. For example, the kicker can place the lower tip of the football near point 220, on a portion of the kicking surface towards lateral portion 155 of support wall 120. The kicker can then lean the top of the football toward the opposite side of kickoff tee 100 and rest the football on lateral portion 160 of support wall 120. Such an orientation is desirable for some soccer-style kickers who believe leaning the football away from them provides them with a larger "sweet spot" on the football to kick. The kicker can also lean the football the opposite direction by placing the lower tip of the football near point 230, on a portion of kicking surface 130 towards lateral portion 160 of support wall 120. The kicker can then lean the top of the football toward the opposite side of tee 100 and rest the football on lateral portion 155 of support wall 120. Additionally, the kicker can lean the football forward or backward by placing the lower tip of the football more towards the proximal or distal end of kickoff tee 100. For example, the kicker can lean the ball forward (or away from the kicker) by placing the lower tip of the football near point 240, located near proximal portion of support wall 120. The kicker can then lean the top of the football toward the distal end of kickoff tee 100 and rest the football on opposing protrusions 170, 175. If the kicker desires to lean the football backward (or toward the kicker), the kicker can place the lower tip of the football near point 250, located towards the distal end of kickoff tee 100. The kicker can then lean the top of the football toward the proximal end of kickoff tee 100 and rest the football on proximal portion 150 of support wall 120. Of course, the orientations described above are exemplary only and should not be construed an exhaustive list of ways in which a kicker can utilize tee 100 in performing a kickoff. The relatively large size of kicking surface 130 and the openness of kickoff tee 100 can adequately support a football at a variety of angles and orientations.

A kicker can also use kickoff tee 100 for on-side kicks. For example, the kicker can place the lower tip of the football near point 260, located on the ground in front of the distal end of kickoff tee 100. The kicker can then lean the top of the football towards the proximal end of tee 100 and rest the football against on-side kick support surface 140 or against the edge where onside kick support surface 140 meets kicking surface 130.

Figure 3:
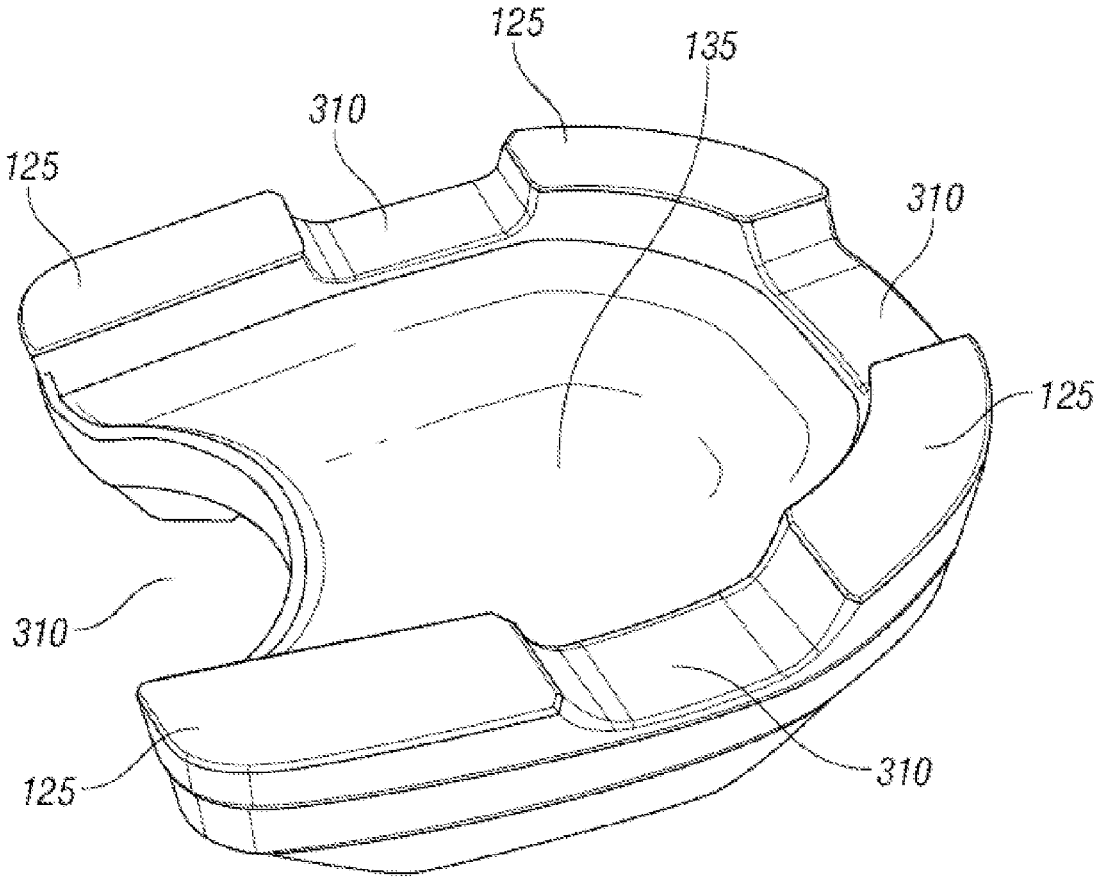
FIG. 3 is a bottom view of the exemplary embodiment of a kickoff tee as described herein.

FIG. 3 depicts a perspective view of the bottom of kickoff tee 100. In one embodiment, lower surface 135 of base portion 115 can comprise a substantially concave surface. In other embodiments, lower surface 135 can define a cavity of some other shape. For example, lower surface 135 can define a cavity of rectangular or square cross section. In other embodiments, lower surface 135 can be substantially flat and/or horizontal with respect to the ground.

Where lower surface 135 defines a cavity, such as a dome-like cavity where lower surface 135 is substantially concave, effective leveling of kickoff tee 100 on a grass or turf surface can be facilitated. For example, when kickoff tee 100 is placed on a grass surface, the blades of grass can occupy the cavity under kickoff tee 100 without making sufficient contact with lower surface 135 of base portion 115 to alter the tees orientation with respect to the ground. The presence of a cavity under kickoff tee 100 can also render kickoff tee 100 lighter in weight, more flexible, and reduce the cost of materials necessary to make the kickoff tee.

In another aspect, leg portions 125 can be spaced apart from one another so as to define channels 310 therebetween. Similar to the cavity defined by lower surface 135, channels 310 can facilitate leveling of kickoff tee 100 on a grass or turf surface. For example, when kickoff tee 100 is placed on a grass surface, the blades of grass can occupy channels 310 without making sufficient contact with kickoff tee 100 to alter the tees orientation with respect to the ground.

Figure 4:
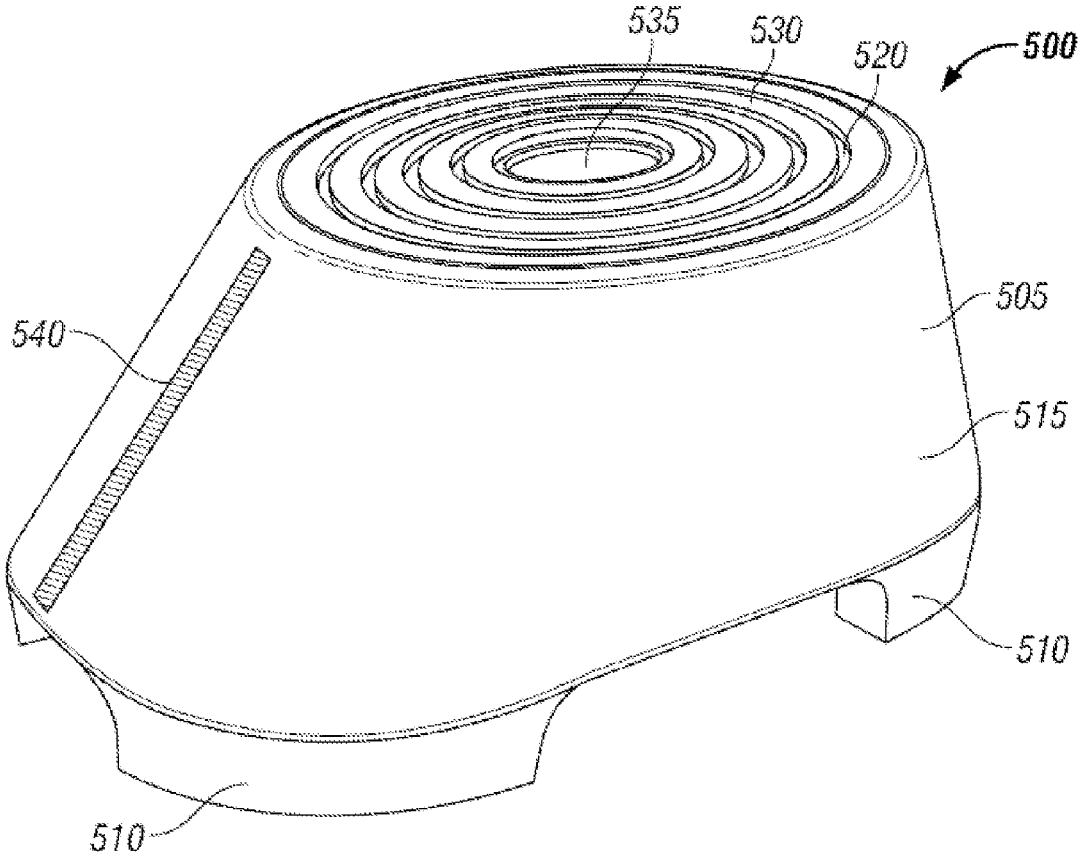
FIG. 4 is a proximal (or rear) perspective view of another exemplary embodiment of a placement tee as described herein.

FIG. 4 depicts an exemplary embodiment of a placement tee 500 from a proximal perspective view. In one aspect, placement tee 500 can comprise a kicking platform portion 505 and leg portions 510. In one embodiment, kicking platform 505 and leg portions 510 can be integrally formed using a single mold. In other embodiments, kicking platform 505 and leg portions 510 can be distinct pieces coupled to one another in some fashion.

Placement tee 500 can be made of any suitable material. In one embodiment, placement tee 500 can comprise a plastic or elastomer. In some embodiments, the rubber or elastomer can be relatively soft so as to prevent injury to a kicker who inadvertently strikes placement tee 500 while attempting a kick. In other embodiments, placement tee 500 can be comprised of a harder rubber or elastomer. Alternatively, placement tee 500, or any of its constituent parts, can comprise some other material, such as rubber, polymer, metal, or wood. It is noted that this list of materials is not intended to be exhaustive and is only exemplary in nature. In further embodiments, multiple materials can be used to construct one or more portions of placement tee 500.

In another aspect, placement tee 500 is sized in accordance with the applicable rules governing the game of football in which it is used. In one embodiment, placement tee 500 is approximately 1 inch tall, 3.5 inches wide, and 5.5 inches long. In another embodiment, placement tee 500 is approximately 2 inches tall, 3.5 inches wide, and 5 inches long. In other embodiments, placement tee 500 exhibits a shorter or longer height, width, and/or length, in compliance with applicable rules.

Figure 7:
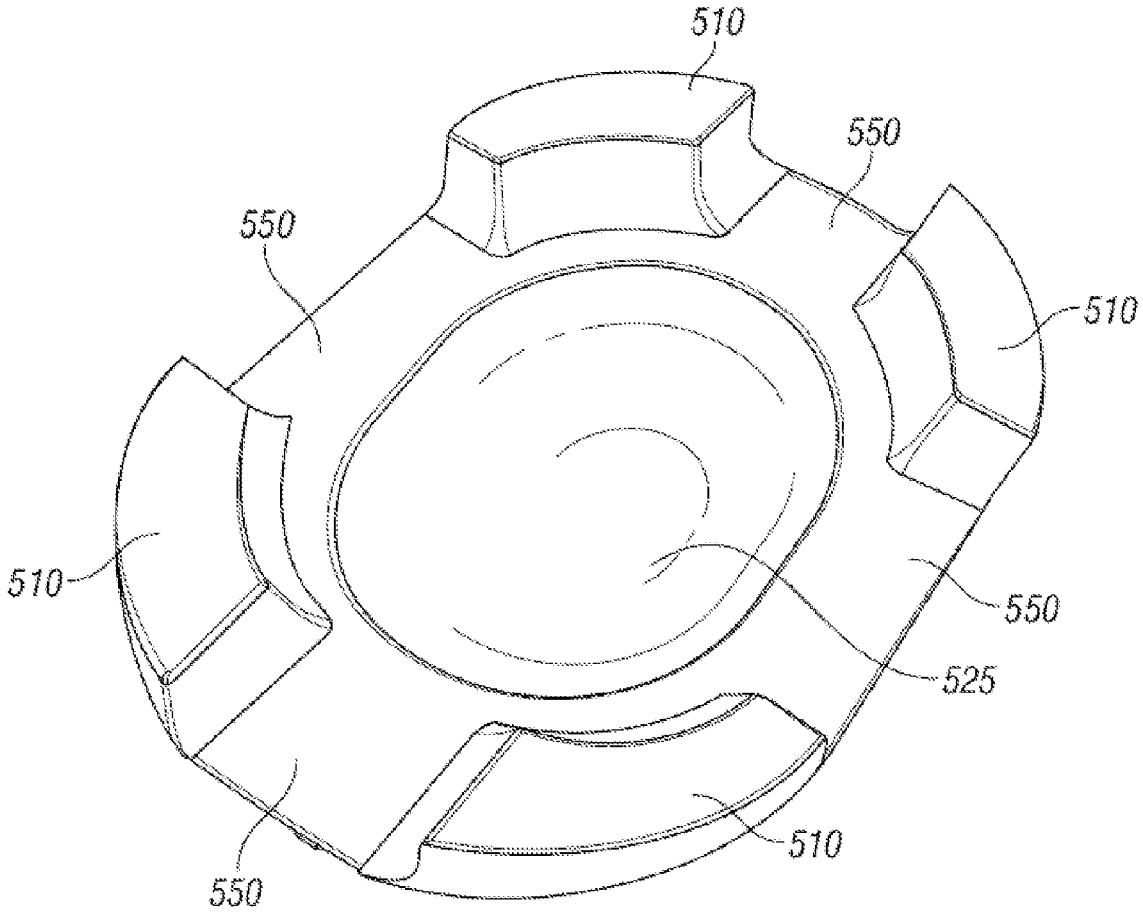
FIG. 7 is a bottom view of the exemplary embodiment of a placement tee as described herein.

In one aspect, kicking platform 505 of placement tee 500 can be comprised of a lateral surface 515, an upper kicking surface 520, and a lower surface 525 (depicted in FIG. 7). In one embodiment, kicking surface 520 can be a substantially horizontal surface with a substantially circular perimeter. In other embodiments, kicking surface 520 can exhibit a substantially elliptical perimeter resembling the cross section of a prolate spheroid or ellipsoid. It is noted that the terms "prolate spheroid" and "ellipsoid" are not used here in their precise geometric sense. Rather, a section of these shapes can resemble kicking surface 520. In other embodiments, the surface area of kicking surface 520 can exhibit some other shape. For example, the perimeter of kicking surface 520 can exhibit a substantially polygonal perimeter. Alternatively, kicking surface 520 can exhibit a perimeter comprised of some combination of linear and curvilinear sides. Further, rather than being substantially horizontal, kicking surface 520 can lie in a plane at some angle to the ground. For example, kicking surface 520 can lie in a plane angled such that the distal end (end of the tee positioned away from the kicker) of kicking surface 520 is closer to the ground than the proximal end (end of the tee positioned closest to the kicker) of kicking surface 520. Alternatively, kicking surface 520 can lie in a plane angled such that the distal end of kicking surface 520 is farther from the ground than the proximal end of kicking surface 520.

In one aspect, kicking surface 520, at its widest portion, can be narrower than the remainder of kicking platform 505, at its widest portion. In other embodiments, kicking surface 520, at its widest portion, can have the same width as the remainder of kicking platform 505, at its widest portion. In still further embodiments, kicking surface 520, at its widest portion, can be wider than the remainder of kicking platform 505, at its widest portion.

In one embodiment, kicking surface 520 can be approximately 3.25 inches wide at its widest portion, while kicking platform 505 can be approximately 3.5 inches wide at its widest portion. In other embodiments, kicking surface 520, at its widest portion, is 95% of the width of kicking platform 505 at its widest portion. In further embodiments, kicking surface 520, at its widest portion, is 90% or less of the width of kicking platform 505.

In another aspect, kicking surface 520 can comprise a plurality of support ridges 530. Support ridges 530 can be formed integrally with kicking surface 520 or separately from kicking surface 520 and then coupled thereto in some fashion. Further, support ridges 530 can be comprised of the same material as kicking surface 520 or support ridges 530 can be comprised of any other suitable material. In one embodiment, each of support ridges 530 is a substantially circular and concentric with the approximate center of kicking surface 520. In this manner, support ridges 530 can achieve a "bullseye" or "dart board" effect that draws a holder's and/or kicker's eye towards the center of kicking surface 520, even upon a relatively quick glance at placement tee 500.

In one aspect, support ridges 530 can extend 1/16 of an inch from kicking surface 520. In other embodiments, support ridges 530 can be shorter than 1/16 of an inch. In further embodiments, support ridges 530 can be taller than 1/16 of an inch.

In one aspect, support ridges 530 can have a substantially rectangular or square cross section. In other embodiments, support ridges 530 can have a substantially circular or elliptical cross section. Alternatively, support ridges 530 can be comprised of a plurality of dimples or a plurality of pyramid-like gripping elements that follow the substantially concentric pattern depicted in FIG. 4.

In another aspect, support ridges 530 can exhibit a different color than the remainder of kicking surface 520. In other embodiments, support ridges 530 can exhibit the same color as the remainder of kicking surface 520.

In addition to providing a visual aid to the holder and/or kicker, support ridges 530 can serve to provide additional support to the lower tip of a football placed on placement tee 500 by a holder through the friction they provide to the lower tip of the football. In this manner, support ridges 530 can help stabilize the football when it is placed on placement tee 500 and facilitate a "clean" hold by the holder.

In one aspect, kicking surface 520 and/or support ridges 530 can comprise a relatively rough material or exhibit a high coefficient of friction. In other embodiments, kicking surface 520 and/or support ridges 530 can comprise a relatively smooth material or exhibit a lower coefficient of friction.

In another aspect, kicking surface 520 can comprise a kicking target 535. In one embodiment, kicking target 535 can be positioned at substantially the center of kicking surface 520. In other embodiments, kicking target 535 can be positioned at some other location on kicking surface 520. In some embodiments, kicking target 535 can be substantially circular and substantially concentric with support ridges 530. In other embodiments, kicking target 535 can have some other shape. For example, kicking target 535 can conform in shape to whatever shape support ridges 530 exhibit. Alternatively, kicking target 535 can be a shape different from whatever shape support ridges 530 exhibit.

In one aspect, kicking target 535 can be of a different color than support ridges 530 and/or kicking surface 520. For example, kicking target 535 and support ridges 530 and/or kicking surface 520 can exhibit different colors that provide substantial contrast between kicking target 535 and/or kicking surface 520. In this manner, a holder's and/or kicker's eye is easily drawn to kicking target 535, even upon a quick glance at placement tee 500. In other embodiments, kicking target 535 can exhibit the same color as support ridges 530 and/or kicking surface 520.

In another aspect, kicking target 535 can be comprised of a material different from that of support ridges 530 and/or kicking surface 520. For example, kicking target 535 can be comprised of a material relatively soft compared to support ridges 530 and/or kicking surface 520. Alternatively, kicking target 535 can be comprised of a material relatively hard compared to support ridges 530 and/or kicking surface 520. Similarly, kicking target 535 can exhibit a relatively rough surface compared to support ridges 530 and/or kicking surface 520. Or kicking target 535 can exhibit a relatively smooth surface compared to support ridges 530 and/or kicking surface 520. A difference in material hardness and/or texture can facilitate better support for the lower tip of a football placed on placement tee 500, as well as provide the holder with a tactile element to aid the holder in locating kicking target 535 without having to look at placement tee 500.

In one aspect, kicking platform 505 can comprise a lateral surface 515. In one embodiment, lateral surface 515 comprises one continuous wall extending around kicking platform 505. In other embodiments, lateral surface 515 comprises two or more curvilinear or linear walls. In such an embodiment, the walls of lateral surface 515 can be integral with each other or formed separately and coupled to one another in some fashion.

In another aspect, kicking platform 505 can comprise a substantially elliptical base and taper upward to a substantially circular portion commensurate with the shape of kicking surface 520. In this manner, the upper portion of lateral surface 515 can transition cleanly into kicking surface 520, while the lower substantially elliptical base portion can aid the kicker and/or holder in lining up the kick. In other words, the kicker and/or holder can position placement tee 500 on the ground such that the two most distant points on the substantially elliptical base form a line intersecting with the kicker's target (e.g., the midpoint between a pair of goal posts).

Alternatively, kicking platform 505 can comprise a base of some other shape. For example, kicking platform 505 can comprise a rectangular base with minor sides at its proximal and distal ends and major sides at its lateral sides. Such a rectangle retains the directional quality described above with respect to a substantially elliptical base. In other embodiments, kicking platform 505 can comprise a base of some other shape comprising rectilinear and/or linear lines. Similarly, the upper portion of kicking platform 505 can conform to whatever shape kicking surface 520 exhibits.

Further, in some embodiments, the slope of lateral surface 515, from the base of placement tee 500 up to kicking surface 520 is more severe (closer to perpendicular to the ground) at the distal end of placement tee 500 than the slope of lateral surface 515 at the proximal end of placement tee 500. By implementing a less severe slope of lateral surface 515 at the proximal end of placement tee 500 (the end from which a kicker approaches), a kicker's foot can easily approach a football placed atop placement tee 500 and swing upward, from the ground to the football, without risk of striking lateral surface 515. In other embodiments, however, the slope of lateral surface 515 at the distal end of placement tee 500 can be less severe (even less severe than the slope of lateral surface 515 at the proximal end of placement tee 500). Similarly, in further embodiments, the slope of lateral surface 515 at the proximal end of placement tee 500 can be more severe (even more severe than the slope of lateral surface 515 at the distal end of placement tee 500).

Figure 5:
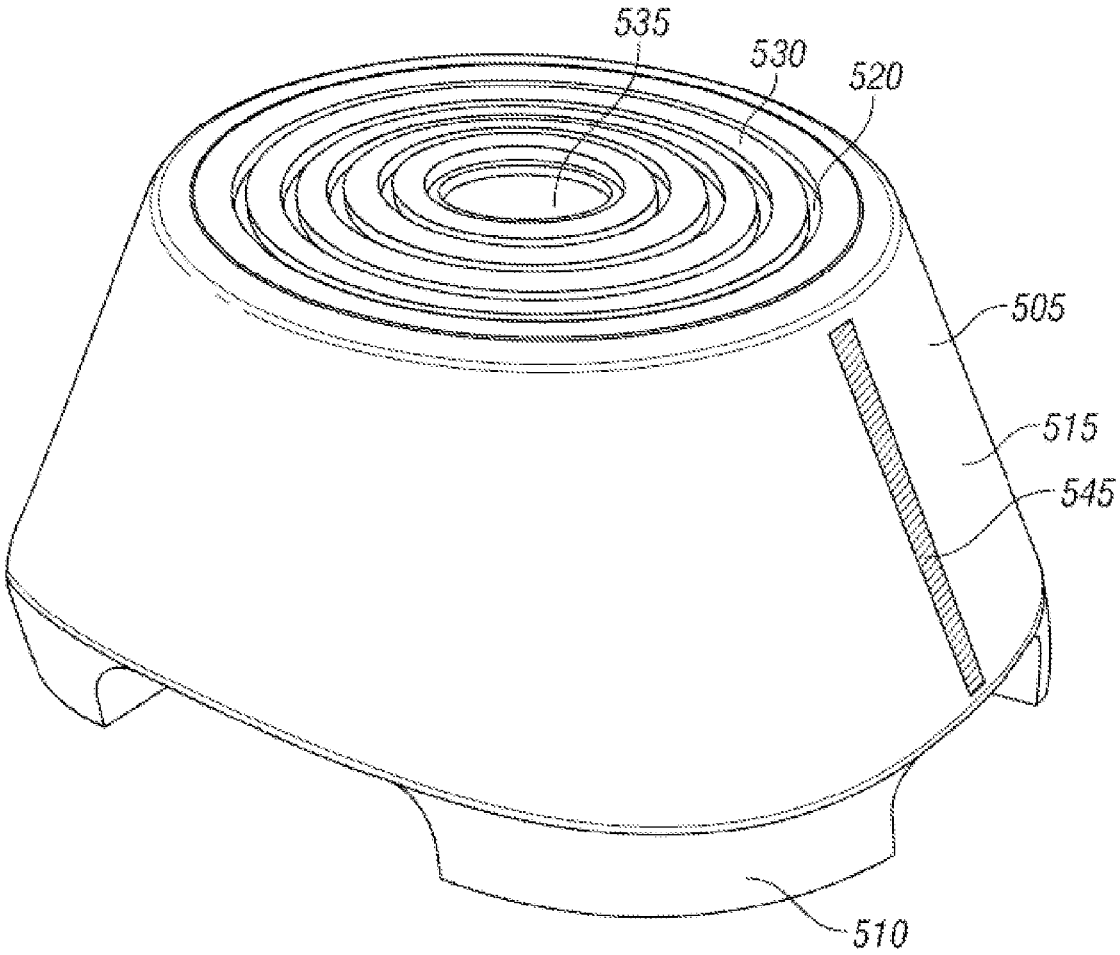
FIG. 5 is a distal (or front) perspective view of the exemplary embodiment of a placement tee as described herein.

In another aspect, lateral surface 515 can comprise a proximal visual indicator 540 and a distal visual indicator 545 (depicted in FIG. 5). In one embodiment, proximal visual indicator 540 can comprise a portion of a line intersecting the proximal end of placement tee 500 and kicking target 535. In another aspect, proximal visual indicator 540 can extend substantially the entire height of kicking platform 505 from its lower base portion to its upper portion intersecting with kicking surface 520. In other embodiments, proximal visual indicator 540 can be shorter in length, only extending over a portion of the height of kicking platform 505. In further embodiments, proximal visual indicator 540 can extend from the proximal end of placement tee 500, through kicking target 535, and down to the distal end of placement tee 500. Alternatively, proximal visual indicator 540 can extend over any shorter length of placement tee 500 along a line between its proximal and distal ends. In this manner, a holder and/or kicker can easily align placement tee 500 so as to provide the kicker with a directional indicator indicating the direction of the target (e.g., the midpoint between a pair of field goal posts) and, in some cases, the preferred trajectory of the kicker's leg during the kick.

In another aspect, proximal visual indicator 540 can exhibit a color different from the color exhibited by the remainder of lateral surface 515. For example, proximal visual indicator 540 and the remainder of lateral surface 515 can exhibit different colors that provide substantial contrast between proximal visual indicator 540 and lateral surface 515. In this manner, the holder's and/or kicker's eye is easily drawn to proximal visual indicator 540, even upon a quick glance at placement tee 500. In other embodiments, proximal visual indicator 540 can exhibit the same color as the remainder of lateral surface 515.

In one aspect, proximal visual indicator 540 can comprise a raised surface with respect to the remainder of lateral surface 515. In this manner, proximal visual indicator 540 can be more visually apparent and/or provide the kicker and/or holder with a tactile element to facilitate lining placement tee 500 up for a kick. In other embodiments, proximal visual indicator 540 can lie in the same plane as the remainder of lateral surface 515. In still further embodiments, proximal visual indicator 540 can comprise a groove or recess with respect to the remainder of lateral surface 515.

In another aspect, placement tee 500 can comprise leg portions 510. In one embodiment, leg portions 510 can be formed integrally with kicking platform 505. In other embodiments, leg portions 510 can be distinct elements coupled to placement tee 500 in some fashion. Further, leg portions 510 can be made of the same material as kicking platform 505. Alternatively, leg portions 510 can be made of some other suitable material.

In one embodiment, leg portions 510 can comprise four legs that extend from the lower surface of kicking platform 505 to the ground. In other embodiments, leg portions 510 can comprise more than four legs. In further embodiments, leg portions 510 can comprise fewer than four legs. In still further embodiments, leg portions 510 can comprise a single leg that extends around the lower perimeter of placement tee 500. Alternatively, placement tee 500 may not comprise leg portions 510 at all. In such an embodiment, lower surface 525 (depicted in FIG. 7) of kicking platform 505 can be placed in contact with the ground when placement tee 500 is in use.

FIG. 5 depicts a distal perspective view of placement tee 500. In one aspect, lateral surface 515 can comprise distal visual indicator 545. In one embodiment, distal visual indicator 545 can comprise a portion of a line intersecting the distal end of placement tee 500 and kicking target 535. In another aspect, distal visual indicator 545 can extend substantially the entire height of kicking platform 505 from its lower base portion to its upper portion intersecting with kicking surface 520. In other embodiments, distal visual indicator 545 can be shorter in length, only extending over a portion of the height of kicking platform 505. In further embodiments, distal visual indicator 545 can extend from the distal end of placement tee 500, through kicking target 535, and down to the proximal end of placement tee 500. Alternatively, distal visual indicator can extend over any shorter length of placement tee 500 along a line between its distal and proximal ends. In this manner, a holder and/or kicker can easily align placement tee 500 so as to provide the kicker with a directional indicator indicating the direction of the target (e.g., the midpoint between a pair of field goal posts) and, in some cases, the preferred trajectory of the kicker's leg during the kick.

In an embodiment comprising both a distal and proximal visual indicator, the holder and/or kicker can use both lines, in conjunction with one another, to facilitate lining up of placement tee 500 and providing the kicker with a directional indicator of the target (e.g., the midpoint between a pair of goal posts), without the kicker having to take his eyes off of placement tee 500. Alternatively, in an embodiment comprising only one of the distal and proximal visual indicators, the holder and/or kicker can use the single indicator to align placement tee 500 and provide the kicker with a directional indicator of the target, without the kicker having to take his eyes off of placement tee 500.

In another aspect, distal visual indicator 545 can exhibit a color different from the color exhibited by the remainder of lateral surface 515. For example, distal visual indicator 545 and the remainder of lateral surface 515 can exhibit different colors that provide substantial contrast between distal visual indicator 545 and lateral surface 515. In this manner, the holder's and/or kicker's eye is easily drawn to distal visual indicator 540, even upon a quick glance at placement tee 500. In other embodiments, distal visual indicator 545 can exhibit the same color as the remainder of lateral surface 515.

In one aspect, distal visual indicator 545 can comprise a raised surface with respect to the remainder of lateral surface 515. In this manner, distal visual indicator 545 can be more visually apparent and/or provide the kicker and/or holder with a tactile element to facilitate lining placement tee 500 up for a kick. In other embodiments, distal visual indicator 545 can lie in the same plane as the remainder of lateral surface 515. In still further embodiments, distal visual indicator 545 can comprise a groove or recess with respect to the remainder of lateral surface 515.

Figure 6:
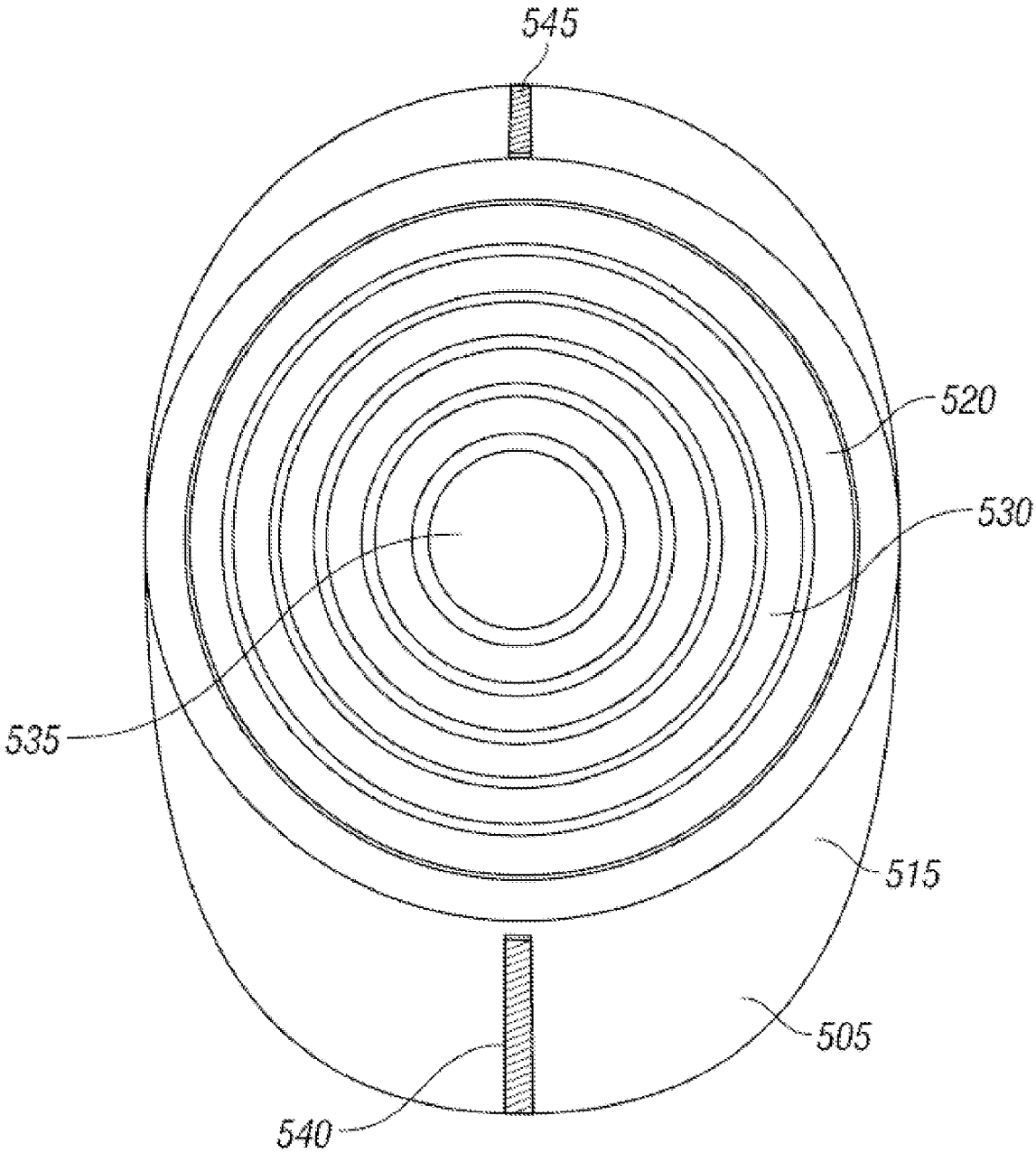
FIG. 6 is a top view of the exemplary embodiment of a placement tee as described herein.

FIG. 6 depicts a top view of placement tee 500. From this vantage point, the directional quality of the lower portion of kicking platform 505 can clearly indicate the direction of the kicker's target (e.g., the midpoint between a pair of goal posts). Similarly, proximal and distal visual indicators 540, 545 can provide an even more exact indication as to the direction of the kicker's target. As discussed above, these features can allow the kicker to focus solely on the placement tee and the football when making a kick, rather than having to split his attention between the football and the target. The "bulls-eye" formed by support ridges 530 and kicking target 535 can also seen. This feature can allow both the kicker and holder to quickly locate the proper placement of a football on placement tee 500. Kicking target 535 can also provide a reference point for the holder and the kicker such that both can anticipate where the football will be placed prior to the snap of the football. Further, in an instance where the football is misplaced (i.e., on support ridges 530 rather than kicking target 535), support ridges 530 provide an adequate surface from which to kick the football.

FIG. 7 depicts a perspective view of the bottom of placement tee 500. In one embodiment, lower surface 525 of kicking platform 505 can comprise a substantially concave surface. In other embodiments, lower surface 525 can define a cavity of some other shape. For example, lower surface 525 can define a cavity of rectangular or square cross section. In other embodiments, lower surface 525 can be substantially flat and/or horizontal with respect to the ground.

In an embodiment where lower surface 525 defines a cavity, such as a dome-like cavity where the lower surface is substantially concave, effective leveling of placement tee 500 on a grass or turf surface can be facilitated. For example, when placement tee 500 is placed on a grass surface, the blades of grass can occupy the cavity under the tee without making sufficient contact with lower surface 525 of kicking platform 505 to alter placement tee 500's orientation with respect to the ground. The presence of a cavity under placement tee 500 can also render the tee lighter in weight, more flexible, and reduce the cost of materials necessary to make placement tee 500.

In another aspect, leg portions 510 can be spaced apart from one another so as to define channels 550 therebetween. Similar to the cavity defined by lower surface 525, channels 550 can facilitate leveling of placement tee 500 on a grass or turf surface. For example, when placement tee 500 is placed on a grass surface, the blades of grass can occupy channels 550 without making sufficient contact with placement tee 500 to alter placement tee 500's orientation with respect to the ground.

It should further be appreciated that additional features can also be incorporated into the kickoff tees and placement tees described above to improve their functionality. Additionally, other embodiments will be apparent from consideration of the specification and practice of the present disclosure. It is intended that the specification and examples be considered as exemplary only, with a true scope and spirit of the invention being indicated by the following claims.

What is claimed is:

1. A placement tee for use during a placement kick, comprising:

a kicking surface; and a lateral surface extending downward from the kicking surface towards a ground surface, wherein:

the kicking surface comprises a kicking target and a plurality of support ridges, and the lateral surface further comprises at least one visual indicator;

wherein the plurality of support ridges comprises a plurality of substantially concentric annular support ridges surrounding the kicking target.

2. The placement tee according to claim 1, wherein the at least one visual indicator comprises:

a proximal visual indicator; and a distal visual indicator.

3. The placement tee according to claim 2, wherein the proximal and distal visual indicators are a different color than the remainder of the lateral surface.

4. The placement tee according to claim 1, wherein the kicking target exhibits a texture different from that of the remainder of the kicking surface.

5. The placement tee according to claim 1, wherein the lateral surface has a lesser slope with respect to the ground surface at a proximal end of the placement tee than at a distal end of the placement tee.

6. The placement tee according to claim 1, wherein the kicking target exhibits a color different from that of the remainder of the kicking surface.

* * * * *